US010173256B2

(12) United States Patent
Lan et al.

(10) Patent No.: US 10,173,256 B2
(45) Date of Patent: Jan. 8, 2019

(54) RADIAL ROLLING PROCESS FOR RING PRODUCT THAT CAN CONTROL STRAIN DISTRIBUTION OF RING PRODUCT

(71) Applicant: WUHAN UNIVERSITY OF TECHNOLOGY, Wuhan, Hubei (CN)

(72) Inventors: Jian Lan, Hubei (CN); Lin Hua, Hubei (CN); Dongsheng Qian, Hubei (CN); Huajie Mao, Hubei (CN); Shaogui Feng, Hubei (CN)

(73) Assignee: WUHAN UNIVERSITY OF TECHNOLOGY, Wuhan, Hubei (CN)

( * ) Notice: Subject to any disclaimer, the term of this patent is extended or adjusted under 35 U.S.C. 154(b) by 196 days.

(21) Appl. No.: 15/180,257

(22) Filed: Jun. 13, 2016

(65) Prior Publication Data

US 2017/0080477 A1 Mar. 23, 2017

(30) Foreign Application Priority Data

Sep. 23, 2015 (CN) ..... 2015 1 0613162

(51) Int. Cl.
*B21H 1/06* (2006.01)

(52) U.S. Cl.
CPC ..... *B21H 1/06* (2013.01)

(58) Field of Classification Search
CPC ... B21H 1/06; B21H 1/08; B21H 1/10; B21H 1/12; B21B 5/00; B21D 17/04
USPC ..... 700/148–152
See application file for complete search history.

(56) References Cited

U.S. PATENT DOCUMENTS 6,978,546 B2 * 12/2005 Andersson ..... B21H 1/12 72/364
9,592,547 B2 * 3/2017 Takizawa ..... B21H 1/06
2016/0082553 A1 * 3/2016 Hua ..... B21H 1/06 29/890.12

FOREIGN PATENT DOCUMENTS

CN 101417310 A * 4/2009
CN 203044764 U * 7/2013

OTHER PUBLICATIONS

Translation from EPO for CN203044764U accessed in Feb. 2018.*
Translation from EPO for CN101417310A accessed in Feb. 2018.*

* cited by examiner

*Primary Examiner* — Pradeep C Battula
(74) *Attorney, Agent, or Firm* — Tim Tingkang Xia, Esq.; Locke Lord LLP

(57) ABSTRACT

The invention provides a radial ring rolling process for controlling strain distribution of a ring product. In the process, a ring blank is rolled by a main roll and a mandrel that are driven to rotate, while a gap between the main roll and the mandrel continuously decreases in the radial direction of the ring blank. The process includes (A) according to dimensions of the ring product and expected strain, a rolling ratio is firstly determined, dimensions of the ring blank is calculated based on the rolling ratio and the dimensions of the ring product; (B) a rotation speed curve of the mandrel is determined based on the rotation and the radial feeding speeds of the main roll; (C) the ring blank is rolled according to the rotation and radial feeding speeds of the main roll and the calculated rotation speed of mandrel in step (B).

5 Claims, 3 Drawing Sheets

RADIAL ROLLING PROCESS FOR RING PRODUCT THAT CAN CONTROL STRAIN DISTRIBUTION OF RING PRODUCT

CROSS-REFERENCE TO RELATED APPLICATION

This application claims priority to and benefit of Chinese Patent Application No. 201510613162.7, filed Sep. 23, 2015 in the State Intellectual Property Office of P.R. China, which is hereby incorporated herein in its entirety by reference.

FIELD OF THE INVENTION

The present invention provides a radial rolling process for a ring product that can control a strain distribution of the ring product. This invention can improve the uniformity of the microstructure of the rolled ring product and is suitable for large-scale production of ring with high quality and long service life.

BACKGROUND OF THE INVENTION

The conventional ring rolling mill, widely used in practical applications, has a main roll that is driven to rotate at constant speed by electrical motor and reducer and to move in straight line by hydraulic cylinder or pneumatic pump, while the mandrel arbitrarily rotates. The ring blank experiences thickness decreasing and diameter enlarging, while the ring blank continuously goes through the gap between the main roll and mandrel. This mill and process have relative less parameter to adjust, even though the mill is low cost and easy to be manufactured.

For the conventional ring rolling mill, the mandrel can arbitrarily rotate and follow the ring blank because of the friction on their contact surfaces. The rotation speed of mandrel will change with different feeding and rotation speeds of main roll, and thus is arbitrarily and uncontrollable. This state of mandrel will causes the unstable state of the deformation zone of the ring blank, and the difference of the strain measure between the surface and inner of the rolled ring product will be 2-3 times or more. As a result, the rolled ring product will be low quality and short service life because of the uneven distribution strain, grains and hard phases, even though the rolled ring product meets the requirements of shape and dimensions. So it is very necessary to improve the ring rolling mill and process to get more stable plastic deformation method by enhancing the controlling of the ring rolling mill and process. This is the only way to obtain the finer grains and more homogeneous disperse phase for high quality ring products.

SUMMARY OF THE INVENTION

The objective of the present invention is to provide a radial rolling process for a ring product that can control a strain distribution of the ring product. In the rolling process, the ring blank is rolled by a main roll and a mandrel that all are driven to rotate. By matching rotation speeds of the main roll and the mandrel, the strain distribution of a deformation zone of the ring product can be controlled, which will form the stress state being good for uniform strain and greatly improve the homogeneity of the metallurgical microstructure of the rolled ring, finally be suitable to produce large volume of rings with high quality and long service life.

In one aspect, the invention relates to a radial rolling process for a ring product that can control the strain distribution of the ring product. During the rolling process, the ring blank is rolled by a main roll and a mandrel that all are driven to rotate. The process includes the steps of: (A) determine the rolling ratio of the ring and the ring blank dimensions, according to the ring product dimensions and predicted strain measure; (B) determine the rotation speed curve of the mandrel, according to the rotation speed and the feeding speed of the main roll; (C) rolling the ring according to the designed rotated speed and feeding speed of the main roll and the rotation speed curve of the mandrel.

Further, the dimensions of ring blank is calculated as blew, (A) firstly, selecting the rolling ratio λ according to the materials plasticity, for the hot rolling process, taking the value of λ=1.5-3. For the cold rolling process, taking the value of λ=1.3-1.6;

(B) according to the dimensions of ring product, the dimensions of ring blank can be calculated by the formula below, $$\begin{cases} D = \frac{1}{2}\left[\lambda(D_0 + d_0) + \frac{(D_0 - d_0)}{\lambda}\right] \\ d = \frac{1}{2}\left[\lambda(D_0 + d_0) - \frac{(D_0 - d_0)}{\lambda}\right] \end{cases} \tag{1}$$

where, D,d are the outer and inner diameter of the ring product respectively, $D_0$, $d_0$ are the outer and inner diameter of the ring blank respectively.

Further, the rotation speed of mandrel is calculated as blew, (A) for a given rolling mill, the feeding per revolution of ring blank can be calculated as blew, $$\Delta h_p = \left(\frac{P}{n\sigma_s b}\right)^2\left(\frac{1}{D_1} + \frac{1}{D_2} + \frac{1}{D} - \frac{1}{d}\right) \tag{2}$$

where, $\Delta h_P$ is the feeding per revolution of ring blank, P is the rolling force of the mill, $\sigma_s$ is the yield strength of the ring blank material under rolling temperature, b is the axial height of the ring blank, $D_1$, $D_2$ are the outer diameters of the main roll and mandrel, n is the coefficient whose range is 3-6;

(B) according to the dimensions and feeding per revolution of ring blank, the feeding speed can be calculated as blew, $$v = \frac{2n_1 D_1 \Delta h_p}{D_0 + D} \tag{3}$$

where, $n_1$ is the rotate speed of main roll;

(C) According to feeding speed and rotate speed of main roll, the rotate speed of mandrel can be calculated to match with main roll as blew, $$n_2 = \xi \frac{2D_1(b - vt)\left[-b + vt + \frac{-\frac{d_0^2}{4} + \frac{D_0^2}{4} + (b - vt)^2}{2(b - vt)}\right]}{\left[-\frac{d_0^2}{4} + \frac{D_0^2}{4} + (b - vt)\right]D_2} n_1 \tag{4}$$

where, t is time variable of rolling, ξ is speed coefficient. Further, the ξ speed coefficient has the range 0.1-0.4.

Further, when ξ≥1, the difference between surface and middle ports of the rolled ring is vary large, 100%-240%;

when $\xi$=0.1, the unevenness of radial strain distribution of the rolled ring is smaller than 20%, and the unevenness of axial one is smaller than 10%; when $\xi$=0.4, the unevenness of radial strain distribution of the rolled ring is smaller than 50%, and the unevenness of axial one is smaller than 20%.

The present invention has, among other things, the following advantages: the ring blank is rolled in its radial direction by the main roll and mandrel that all are driven. As shown in FIGS. 1 and 2, the ring blank continually experiences plastic deformation under the moment T1 and T2, while the friction forces on the inner and outer surface of the ring blank have different directions and form the state being good for plastic deformation, and the deformation zone is elongated. Because of the different linear velocities of the circumferential points of main roll and mandrel ($n_2<n_1$), the no-slip point (A2) between main roll and ring will move toward deformation exit (A1), while the no-slip point (B3) between mandrel and ring will move toward deformation entry (B4). The area (A2B2B3A3) between those no-slip points is called asynchronous zone because the ring contact points with main roll has opposite linear velocity direction to that with mandrel. The area (A1B1B2A2) is called forward slip zone because the ring contact points with tools have larger linear velocity than those tools' contact points. The area (A3B3B4A4) is called backward slip zone because the ring contact points with tools have smaller linear velocity than those tools' contact points. So the deformation zone consists of forward slip zone, asynchronous zone and backward slip zone. During the rolling process, the elongation of the asynchronous zone changes the deformation condition of the ring deformation zone. By matching and adjusting the velocity of the main roll and mandrel, the stress states can be controlled to obtain uniform deformation. The rotation speed of the mandrel can be determined by the rotation speed and feed speed of the main roll to control the strain distribution of the ring during the rolling process.

BRIEF DESCRIPTION OF THE DRAWINGS

The drawings described below are for illustration purpose only. The drawings are not intended to limit the scope of the present teaching in any way.

Figure 1:
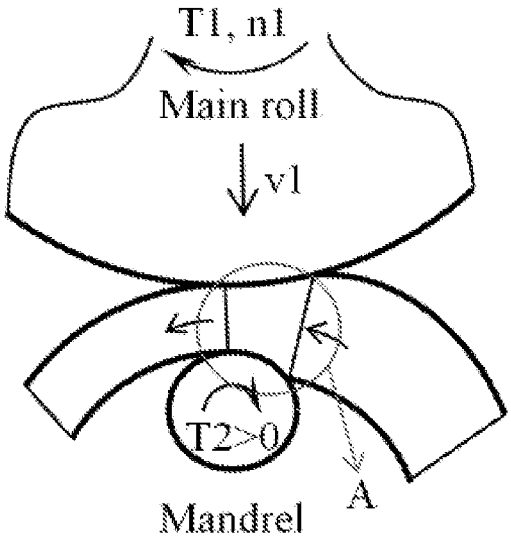
FIG. 1 is the motion and deforming analysis of the ring while the ring is rolled by a main roll and a mandrel that all are driven to rotate.

In figures: 1—forward slip zone; 2—asynchronous zone; 3—backward slip zone.

DETAILED DESCRIPTION OF THE INVENTION

Hereinafter is the preferred embodiment of the invention with reference to the figures.

In one aspect, the invention relates to a radial rolling process for a ring product that can control strain distribution of the ring product. During the rolling process, the ring blank is rolled by a main roll and a mandrel that all are driven to rotate. The process includes the steps of: (A) determine the rolling ratio of the ring blank and the ring blank dimensions, according to the ring product dimensions and predicted strain measure; (B) determine the rotation speed curve of the mandrel, according to the rotation speed and the feeding speed of the main roll; (C) rolling the ring blank according to the designed rotated speed and feeding speed of the main roll and the rotation speed curve of the mandrel.

The dimensions of ring blank is calculated as blew, (A) firstly, selecting the rolling ratio $\lambda$ according to the materials plasticity, for the hot rolling process, taking the value of $\lambda$=1.5-3, for the cold rolling process, taking the value of $\lambda$=1.3-1.6;

(B) according to the dimensions of ring product, the dimensions of ring blank can be calculated by the formula below, $$\begin{cases} D = \frac{1}{2}\left[\lambda(D_0 + d_0) + \frac{(D_0 - d_0)}{\lambda}\right] \\ d = \frac{1}{2}\left[\lambda(D_0 + d_0) - \frac{(D_0 - d_0)}{\lambda}\right] \end{cases} \quad (1)$$

where, D,d are the outer and inner diameter of the ring product respectively, $D_0$,$d_0$ are the outer and inner diameter of the ring blank respectively;

The rotation speed of mandrel is calculated as blew, (A) for a given rolling mill, the feeding per revolution of ring blank can be calculated as blew, $$\Delta h_p = \left(\frac{P}{n\sigma_s b}\right)^2\left(\frac{1}{D_1} + \frac{1}{D_2} + \frac{1}{D} - \frac{1}{d}\right) \quad (2)$$

where, $\Delta h_P$ is the feeding per revolution of ring blank, P is the rolling force of the mill, $\sigma_s$ is the yield strength of the ring blank material under rolling temperature, b is the axial height of the ring blank, $D_1$, $D_2$ are the outer diameters of the main roll and mandrel, n is the coefficient whose range is 3-6;

(B) according to the dimensions and feeding per revolution of ring blank, the feeding speed can be calculated as blew, $$v = \frac{2n_1 D_1 \Delta h_p}{D_0 + D} \quad (3)$$

where, $n_1$ is the rotate speed of main roll;

(C) according to feeding speed and rotate speed of main roll, the rotate speed of mandrel can be calculated to match with main roll as blew, $$n_2 = \xi \frac{2D_1(b - vt)\left[-b + vt + \frac{-\frac{d_0^2}{4} + \frac{D_0^2}{4} + (b - vt)^2}{2(b - vt)}\right]}{\left[-\frac{d_0^2}{4} + \frac{D_0^2}{4} + (b - vt)\right]D_2} n_1 \quad (4)$$

where, t is time variable of rolling, ξ is speed coefficient.

If the mandrel arbitrarily rotates without driven moment during the rolling process, the main roll keeps constant rotation speed $n_1$. The rotation speed of the following mandrel will continually change and opposes to the rotation speed of main roll with the ring blank thickness decreasing. There is no moment $T_2=0$ from the mandrel to the ring blank during rolling process.

Figure 2:
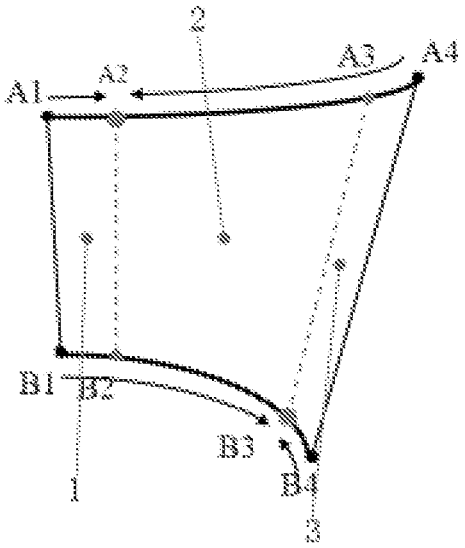
FIG. 2 is the partial enlarged detail of the area A in FIG. 1.

If the mandrel rotates based on the calculated rotation speed as shown in Eqn (4), the ring blank will experience continuous plastic deformation under both the main roll moment $T_1$ and mandrel moment $T_2 \neq 0$, as shown in FIGS. 1 and 2. The friction forces on the inner and outer surface of the ring blank have different directions under the moments $T_1$ and $T_2$. The deformation zone is elongated and forms the state being good for plastic deformation. Because of the different linear velocities of the circumferential points of main roll and mandrel ($n_2<n_1$), the no-slip point (A2) between main roll and ring will move toward deformation exit (A1), while the no-slip point (B3) between mandrel and ring will move toward deformation entry (B4). The area (A2B2B3A3) between those no-slip points is called asynchronous zone 2, because the ring contact points with main roll has opposite linear velocity direction to that with mandrel. The area (A1B1B2A2) is called forward slip zone 1, because the ring contact points with tools have larger linear velocity than those tools' contact points. The area (A3B3B4A4) is called backward slip zone 3, because the ring contact points with tools have smaller linear velocity than those tools' contact points. So the deformation zone consists of forward slip zone 1, asynchronous zone 2 and backward slip zone 3. During the rolling process, the elongation of the asynchronous zone 2 changes the deformation condition of the ring deformation zone. By matching and adjusting the velocity of the main roll and mandrel, the stress states can be controlled to obtain uniform deformation. The rotation speed of the mandrel can be determined by the rotation speed and feed speed of the main roll to control the strain distribution of the ring during the rolling process.

Figure 3:
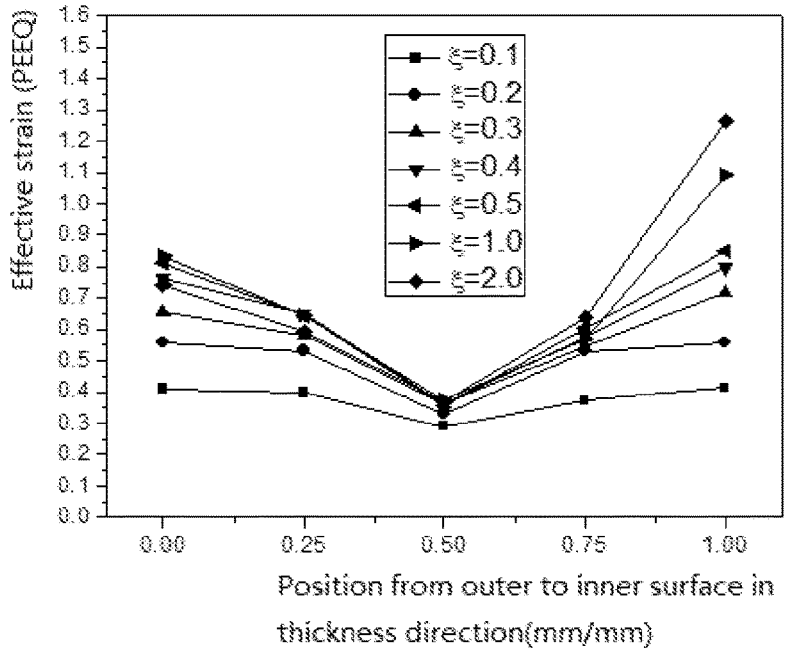
FIG. 3 is the effective strain distribution of the rolled ring by the present invention along radial thickness direction under different speed coefficients, at upper surface in axial direction.
Figure 4:
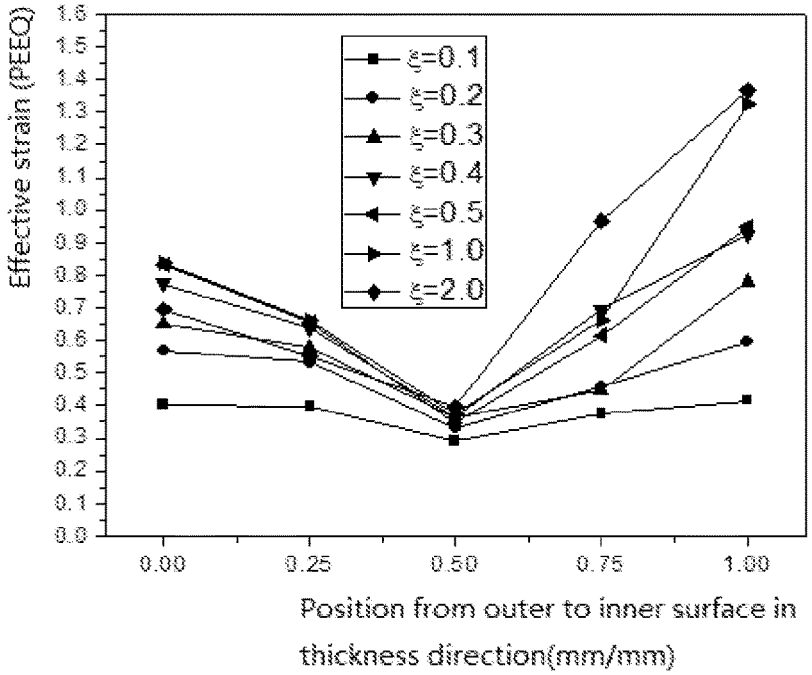
FIG. 4 is the effective strain distribution of the rolled ring by the present invention along radial thickness direction under different speed coefficients, in the middle portion in axial direction.
Figure 5:
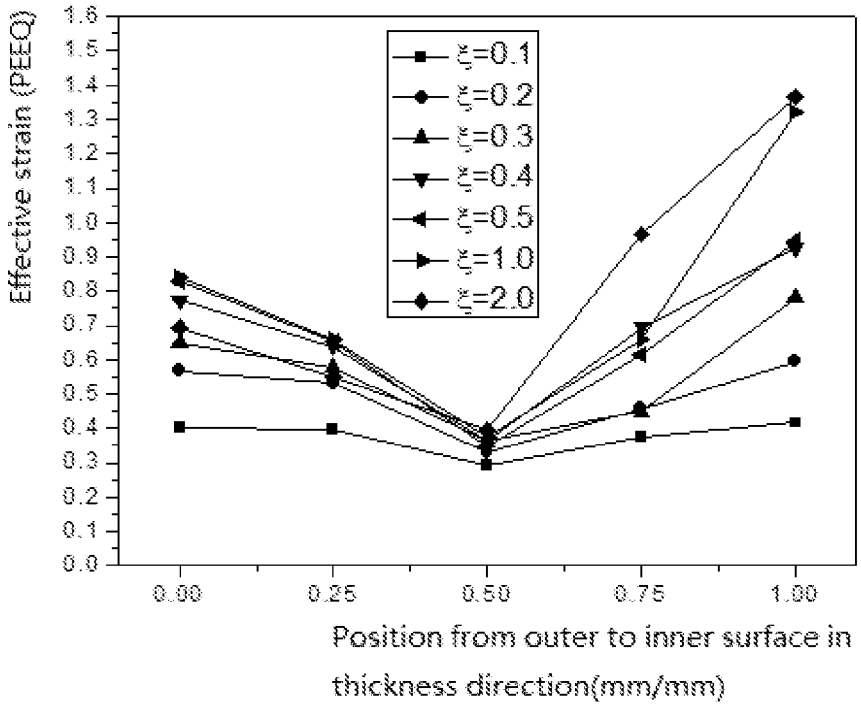
FIG. 5 is the effective strain distribution of the rolled ring by the present invention along radial thickness direction under different speed coefficients, at lower surface in axial direction.

The effective strain changes along the radial direction at different axial positions with different speed coefficients as shown in FIG. 3-5. And the effective strains have almost the same changing trend at different axial positions. When the ring is rolled by the method of this invention with ξ≥1, the strains on the inner and outer surfaces are 100%-240% larger than the strain in the middle thickness portion. When ξ=0.1, the unevenness of strain along radial direction is less than 20%, and the unevenness of strain along axial direction is less than 10%. When ξ=0.4, the unevenness of strain along radial direction is less than 50%, and the unevenness of strain along axial direction is less than 20%. From this, it can be seen that the ring radial rolling process driven by main roll and mandrel can improve the evenness of the strain distribution and the range of ξ is 0.1-0.4. One can obtain the strain distribution with different ξ by experiments and can obtain the rolled rings with different strain distribution by controlling the ξ.

In sum, the present invention is suitable to produce large volume ring products with high quality and long service life.

What should be understood is that one of ordinary skill in the art can make some changes and transformations according to the embodiment above, and all these changes and transformations should belong to the protection scope of the present invention claims.

The present invention provides a radial rolling process for a ring product that can control the strain distribution of the ring product, in the rolling process, the ring blank is rolled by a main roll and a mandrel that all are driven to rotate, while the gap between the main roll and the mandrel continuously decreases in the radial direction of the ring blank, to carry out this process, several steps are taken as below: (A) according to the dimensions of the ring product and the expected strain, the rolling ratio λ is firstly determined, and the dimensions of the ring blank is calculated based on the rolling ratio λ and the dimensions of the ring product; (B) the rotation speed curve of the mandrel is determined based on the rotation speed of the main roll and the radial feeding speed of the main roll; (C) the ring blank is rolled according to the rotation and radial feeding speeds of the main roll and the calculated rotation speed of mandrel in step (B). This rolling process provides the stress state for uniform plastic deformation, which improves greatly the microstructure uniformity of rolled ring product, and is suitable for reliably producing large volumes of ring parts high quality and long service life.

What is claimed is:

1. A radial rolling process for a ring product that controls a strain distribution of the ring product, wherein in the radial rolling process, a ring blank is rolled by a main roll and a mandrel that are driven to rotate, to carry out the radial rolling process, the radial rolling process comprising the following steps:

(A) according to dimensions of the ring product and an expected strain, a rolling ratio λ is firstly determined, and dimensions of the ring blank are calculated based on the rolling ratio λ and the dimensions of the ring product;

(B) a rotation speed curve of the mandrel is determined based on a rotation speed of the main roll and a radial feeding speed of the main roll, so as to determine a feeding speed of the main roll and a rotation speed of the mandrel for a given constant rotation speed of the main roll, comprising:

firstly, a main roll feeding per revolution of the ring blank is calculated based on a rolling force capacity of a rolling mill used in the radial rolling process and a material yield strength of the ring blank;

secondly, the feeding speed of the main roll is calculated based on its feeding per revolution of the ring blank and its rotation speed;

thirdly, the rotation speed of the mandrel is calculated based on the rotation speed of the main roll and the feeding speed of the main roll; and (C) the ring blank is rolled according to the rotation and radial feeding speeds of the main roll and the calculated rotation speed of the mandrel in step (B).

2. The radial rolling process for the ring product that controls the strain distribution of the ring product according to claim 1, wherein the dimensions of the ring blank is calculated as below, (A) firstly, selecting the rolling ratio λ according to a material plasticity, for a hot rolling process, whose temperature is higher than its austenitizing temperature, taking a value of λ=1.5-3, for a cold rolling process, whose temperature is near room temperature, taking a value of λ=1.3-1.6; and (B) according to the dimensions of the ring product, the dimensions of the ring blank are calculated by the formula of $$\begin{cases} D = \frac{1}{2}\left[\lambda(D_0 + d_0) + \frac{(D_0 - d_0)}{\lambda}\right] \\ d = \frac{1}{2}\left[\lambda(D_0 + d_0) - \frac{(D_0 - d_0)}{\lambda}\right] \end{cases} \quad (1)$$

wherein D,d are outer and inner diameters of the ring product respectively, $D_0$,$d_0$ are outer and inner diameters of the ring blank respectively.

3. The radial rolling process for the ring product that controls the strain distribution of the ring product according to claim 1, wherein the rotation speed of the mandrel is calculated as below, (A) for the rolling mill, the feeding per revolution of the ring blank is calculated by the formula of $$\Delta h_p = \left(\frac{P}{n\sigma_s b}\right)^2\left(\frac{1}{D_1} + \frac{1}{D_2} + \frac{1}{D} - \frac{1}{d}\right) \quad (2)$$

wherein $\Delta h_p$ is the feeding per revolution of the ring blank, P is the rolling force of the rolling mill, $\sigma_s$ is the yield strength of the ring blank material under a rolling temperature, b is an axial height of the ring blank, $D_1$, $D_2$ are outer diameters of the main roll and the mandrel, respectively, n is a coefficient whose range is 3-6;

(B) according to the dimensions and the feeding per revolution of the ring blank, the feeding speed is calculated by the formula of $$v = \frac{2n_1 D_1 \Delta h_p}{D_0 + D} \quad (3)$$

wherein $n_1$ is the rotation speed of the main roll; and (C) according to the feeding speed and the rotation speed of the main roll, the rotation speed of the mandrel is calculated to match with the main roll as below, $$n_2 = \xi \frac{2D_1(b - vt)\left[-b + vt + \frac{-\frac{d_0^2}{4} + \frac{D_0^2}{4} + (b - vt)^2}{2(b - vt)}\right]}{\left[-\frac{d_0^2}{4} + \frac{D_0^2}{4} + (b - vt)\right]D_2} n_1 \quad (4)$$

wherein t is a time variable of rolling, ξ is a speed coefficient.

4. The radial rolling process for the ring product that controls the strain distribution of the ring product according to claim 3, wherein the speed coefficient ξ has a value in a range of 0.1-0.4.

5. The radial rolling process for the ring product that controls the strain distribution of the ring product according to claim 3, wherein by adopting the radial rolling process, the speed coefficient ξ has characteristics as below: when ξ≥1, a difference between a surface and middle ports of the rolled ring is 100%-240%; when ξ=0.1, an unevenness of a radial strain distribution of the rolled ring is smaller than 20%, and an unevenness of an axial strain distribution of the rolled ring is smaller than 10%; when ξ=0.4, the unevenness of the radial strain distribution of the rolled ring is smaller than 50%, and the unevenness of the axial strain distribution of the rolled ring is smaller than 20%.

* * * * *